US007165605B2

(12) United States Patent
Park et al.

(10) Patent No.: US 7,165,605 B2
(45) Date of Patent: Jan. 23, 2007

(54) MULTI-TUBE IN SPIRAL HEAT EXCHANGER

(75) Inventors: Young Kyu Park, Simsbury, CT (US); Gary D. Winch, Colchester, CT (US); William A. Rioux, Willington, CT (US)

(73) Assignee: Carrier Corporation, Syracuse, NY (US)

( * ) Notice: Subject to any disclaimer, the term of this patent is extended or adjusted under 35 U.S.C. 154(b) by 148 days.

(21) Appl. No.: 10/716,974

(22) Filed: Nov. 19, 2003

(65) Prior Publication Data

US 2005/0103482 A1 May 19, 2005

(51) Int. Cl.
*F28D 7/04* (2006.01)

(52) U.S. Cl. ..... 165/156; 165/140

(58) Field of Classification Search ..... 165/140, 165/156, 162, 163, 172
See application file for complete search history.

(56) References Cited

U.S. PATENT DOCUMENTS 3,335,790 A * 8/1967 Aranyi et al. ..... 165/156
3,730,229 A 5/1973 D'Onofrio
4,210,199 A 7/1980 Doucette et al.
4,317,268 A * 3/1982 Bowden et al. ..... 165/163
4,451,960 A * 6/1984 Molitor ..... 165/165
4,462,463 A * 7/1984 Gorham, Jr. ..... 165/140
4,599,773 A 7/1986 Sievers
5,004,046 A 4/1991 Jones
5,046,548 A * 9/1991 Tilly ..... 165/140
5,533,362 A * 7/1996 Cook et al. ..... 165/163
5,551,504 A 9/1996 Zifferer
5,709,029 A 1/1998 Innes
6,182,748 B1 2/2001 Brost et al.
6,250,379 B1 * 6/2001 Geissler et al. ..... 165/163
6,397,939 B1 6/2002 Swiger et al.
6,590,770 B1 7/2003 Rogers et al.
6,607,027 B1 8/2003 Bosch et al.

OTHER PUBLICATIONS

PCT International Search Report dated Nov. 29, 2005 for International Application No. PCT/US04/38846.

* cited by examiner

*Primary Examiner*—Teresa J. Walberg
(74) *Attorney, Agent, or Firm*—Carlson, Gaskey & Olds

(57) ABSTRACT

A heat exchanger has a first thermally conductive tube for conducting a fluid and a second thermal conductive tube for conducting a fluid. The first thermally conductive tube forms a first loop while the second thermally conductive tube forms a second loop. The first loop neighbors the second loop.

13 Claims, 6 Drawing Sheets

MULTI-TUBE IN SPIRAL HEAT EXCHANGER

BACKGROUND OF THE INVENTION

This invention relates to a heat exchanger.

A heat exchanger is commonly used for refrigeration, cooling, and heating applications. For these applications, the heat exchanger transfers heat from one fluid to another fluid without the fluids intermingling. The fluid may be a gas or a liquid. For certain high-pressure applications involving $CO_2$ gas, manufacturers have used a tube-in-tube design for a heat exchanger. Essentially, the heat exchanger is one tube containing one fluid surrounded by another larger tube containing the other fluid. For example, $CO_2$ gas may circulate within the inner tube while water may circulate in the surrounding tube. Heat is exchanged through the surface of the inner tube.

For a high-pressure application, tube diameters have to be kept small (less than ⅜ of an inch) to maintain a reasonable wall thickness. For large capacity systems, these tubes are problematic because the heat exchanger requires a large number of parallel circuits. As a consequence, the length of the heat exchanger may be very long.

In addition, water used in the heat exchanger may be used subsequently for consumption or for a sanitary process. It is critical that the water not be contaminated during the heat exchange process. The conventional tube within a tube design poses a risk of water contamination because the tube for one fluid, say water, surrounds the tube of the other heat exchange fluid. Accordingly, rupture of the inner tube within the larger tube would cause contamination of the water in the larger tube.

One proposed solution pipes one heat exchange fluid in a tube that twists around a straight tube having the other fluid. However, due to the different geometries of the tubes, the two tubes may have limited areas of physical contact with each other. Consequently, heat exchange is not very efficient.

The manufacture of this unique heat exchanger presents a challenge as well. Specifically, in the past, manufacturers have produced a helical tube by coiling a single tube around a fixture. In some instances, manufacturers have also coiled a single tube over itself to create multiple layers of coiled tubing in an effort to increase the surface area per linear length of heat exchanger. However, the foregoing techniques fail to coil more than one heat exchanging tube in a tight helical spiral as would be best suited for optimum heat transfer.

A need therefore exists for a heat exchanger and method of manufacturing the heat exchanger that avoids the foregoing deficiencies and improves upon the efficiency of heat exchange.

SUMMARY OF THE INVENTION

The present invention comprises at least a first thermally conductive tube and a second thermally conductive tube. Each tube is capable of conducting a fluid for use in a heat exchange process. In contrast to other designs, the inventive design intertwines the first tube with the second tube so that the loop of one tube neighbors the loop of the other. In this way, the heat exchanger greatly increases the amount of surface area for heat exchange per linear length of tube so that a more compact design may be achieved. In addition, the spiraling of the tubes together induces turbulence of the fluid within the tubes to enhance heat transfer. Spiraling of the tubes together also ensures close physical contact between the tubes to improve heat exchange. Different fluids may pass through each of the tubes and may be brought together for heat exchange. Because each fluid is contained within its own tube, the fluids do not intermingle during heat exchange. The fluids within each of these tubes are further protected against cross-contamination because the tubes do not share a common wall but, in fact, each have their own wall. In the event of rupture of one wall, fluid may leak but will not intermingle with fluid in the other tube.

The loops of the first and second tube may coil around the same axis and may further coil along a generally common angle relative to this axis. Multiple tubes may be intertwined in this way. The coiled tubes may also be encased within a housing. The housing may be another tube that has a fluid inlet and a fluid outlet for a third fluid.

In addition, the tubes may be coiled in such a way as to create a volume within the coils of the tubes. Another heat exchange element may be placed within this volume to augment heat exchange. This additional heat exchange element may spiral in an opposite direction to the spiral of the loops to further improve heat exchange.

The present invention further comprises a method of manufacturing a multiple tube heat exchanger. In contrast to existing manufacturing techniques, the current technique winds a first heat exchanger tube with at least a second heat exchanger tube about a common axis. Both the first exchanger tube and the second heat exchanger tube have free moving portions that wind about the common axis of rotation in a spiral fashion while the other portions of the heat exchanger tubes are fixed against rotation. In this way, multiple tubes may be wound together and intertwined between the rotationally free portions and the fixed portions of the tube. Consequently, the inventive technique allows for the creation of a tight helical spiral with the first heat exchanger tube intertwined with the second heat exchanger tube.

A guide may prevent the fixed portions of the tube from winding around the axis of rotation. The guide may be moveable along the axis so as to alter the location of the fixed portions of the tubes. In this way, sections of the tubes may be intertwined and then the guide moved away from the intertwined section of the tubes to allow other sections of the tubes to be intertwined. This guide permits the tubes to be wound evenly together. Another guide may also be used to hold the fixed portions of the tubes in place.

The tubes may be wound around a rod that extends along the axis of rotation. This rod may define the diameter for the helical coils. In addition, the rod may have a spiral pattern to ensure that the tubes are wound in a helical manner. The rod may be subsequently removed and replaced with a third heat exchange element to create an additional layer for heat exchange.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
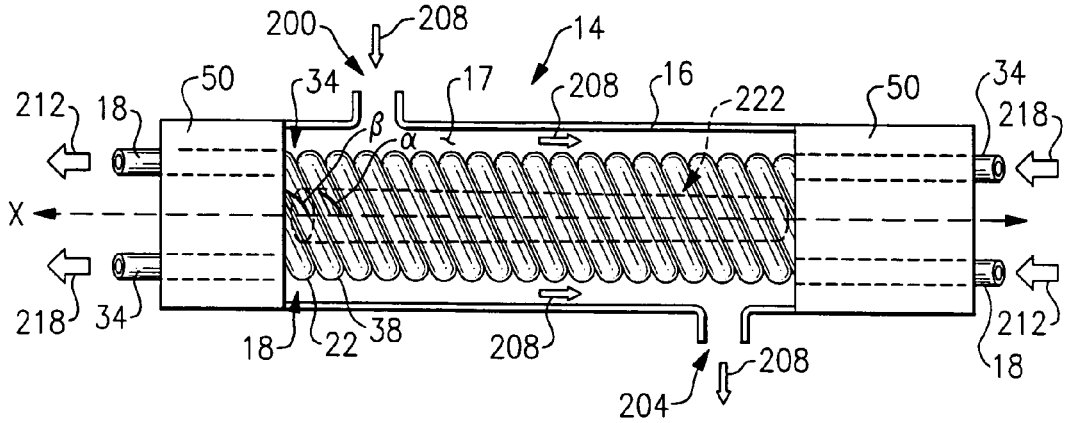
FIG. 1 illustrates a side cross-sectional view of the inventive multiple tube heat exchanger.

FIG. 1 illustrates a side cross-sectional view of multiple tube heat exchanger 14. Multiple tube heat exchanger 14 has hollow tube cylinder 16 capped by fixtures 50 to create fluid volume 17 within cylinder 16. Cylinder 16 has first fluid inlet 200 and first fluid outlet 204. Disposed within fluid volume 17 is first thermally conductive heat exchanger tube 18 and second heat exchanger tube 34 intertwined along axis X such that first heat exchanger tube 18 forms first loop 22 that neighbors and preferably contacts second loop 38 of second heat exchanger tube 34 along axis X. Heat exchange between fluids in first heat exchanger tube 18 and second heat exchanger tube is not only enhanced by their contact but also improved due to the spiraling of the tubes 18, 34, which enhances fluid turbulence and therefore heat exchange.

Figure 2:
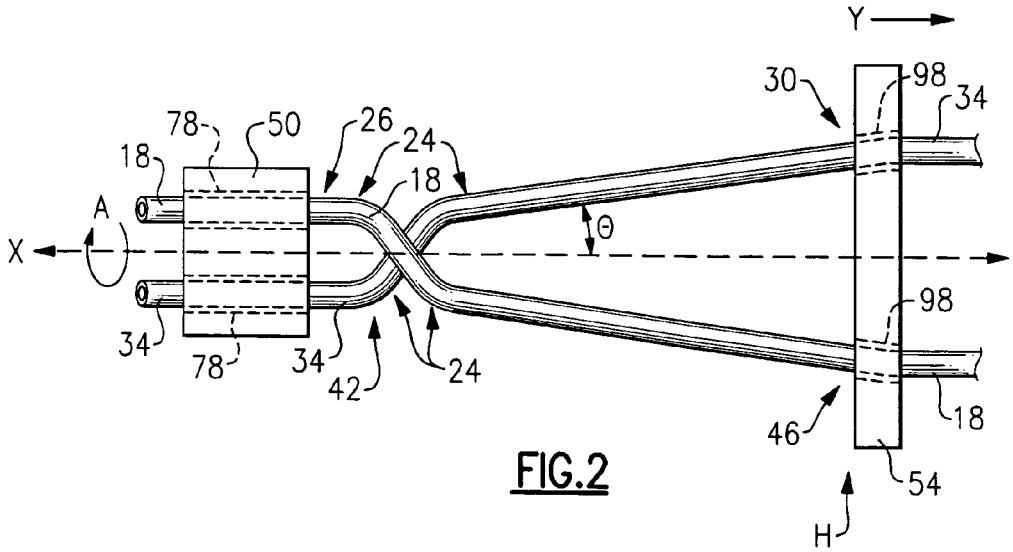
FIG. 2 illustrates the initial winding of one tube relative to another tube.

As shown in FIG. 2, to create the helical intertwining shape of first heat exchanger tube 18 and second heat exchanger tube 34, first heat exchanger tube 18 and second heat exchanger tube 34, both of which are initially straight, are inserted in holes 78 through fixture 50. Preferably, first heat exchanger tube 18 and second heat exchanger tube 34 are a malleable metal, such as copper, to facilitate manufacture as will be explained below. The number of holes will dictate the number of tubes that may be intertwined. In addition, the spacing between first heat exchanger tube 18 relative to second heat exchanger tube 34 as well as other tubes inserted in fixture 50 will dictate the tightness of the spiral.

First heat exchanger tube 18 has first fixed portion 30 inserted through hole 98 of first guide 54 and second heat exchanger tube 34 has second fixed portion 46 inserted through hole 98 of guide 54. Holes 98 are preferably beveled so that tubes 84 may be fed at angle θ, the angle by which first heat exchanger tube 18 and second heat exchanger tube 34 are disposed between fixture 50 and guide 54 relative to the X axis. The tightness of a spiral will be dictated in part by angle θ.

Fixture 50 is free to rotate along the direction of arrow A, say clockwise, so that first rotationally free portion 26 and second rotationally free portion 42 rotate in the same direction. First fixed portion 30 and second fixed portion 46 are fixed against rotation along the direction of arrow A by first guide 54. As a consequence, first heat exchanger tube 18 and second heat exchanger tube 34 form bends 24 as first rotationally free portion 26 and second rotationally free portion 42 wind around axis X.

Figure 3:
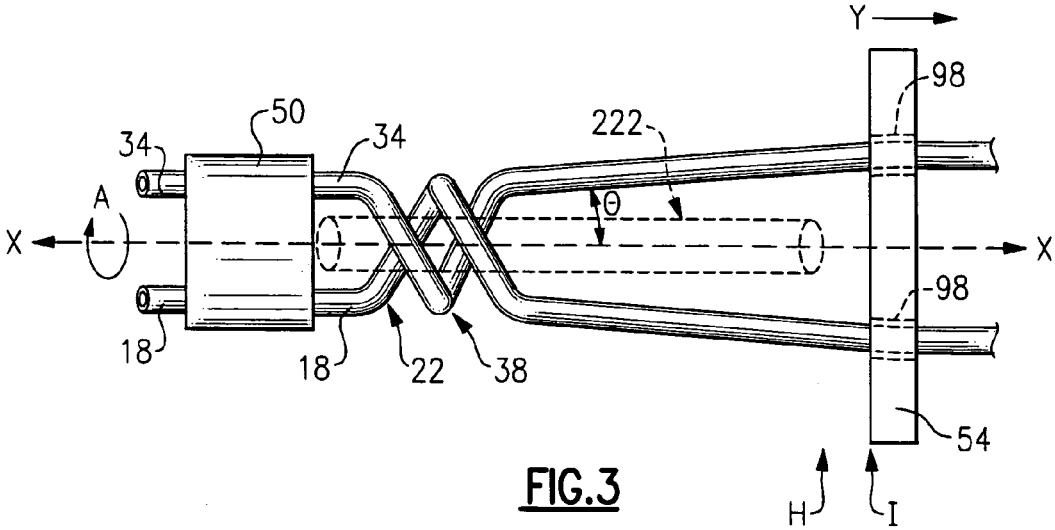
FIG. 3 illustrates the winding of the multiple tubes to form neighboring loops of the multiple tube heat exchanger.

As shown in FIG. 3, as first heat exchanger tube 18 and second heat exchanger tube 34 continue to wind around axis X, first loop 22 of first heat exchanger tube 18 is formed and second loop 38 of second heat exchanger tube 34 is formed. First loop 22 and second loop 38 neighbor and preferably contact each other along the X axis. As first heat exchanger tube 18 and second heat exchanger tube 34 continue to rotate and wind about the X axis, additional loops are formed in a spiral fashion. These loops may be wound to form an internal volume 222 or may be wound tightly to minimize the size of volume 222.

As further loops are created, first guide 54, which is free to move along the X axis, is moved in the direction of arrow Y from position H (see FIG. 2) to position I (see FIG. 3). To maintain the uniformity of loops, it is important that the distance between guide 54 and say loop 38 be kept the same as more and more of first heat exchanger tube 18 and second heat exchanger tube 34 are intertwined.

Figure 5A:
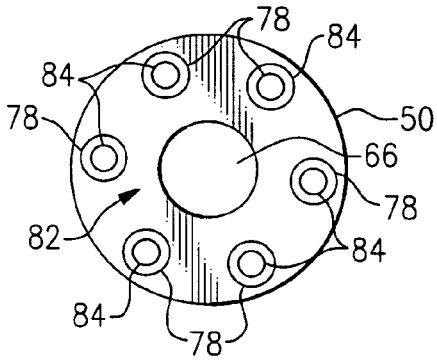
FIG. 5A shows a front view of a fixture used to wind the multiple tubes.
Figure 5B:
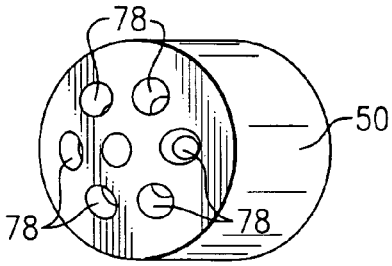
FIG. 5B shows a perspective view of the fixture of FIG. 5A.
Figure 4:
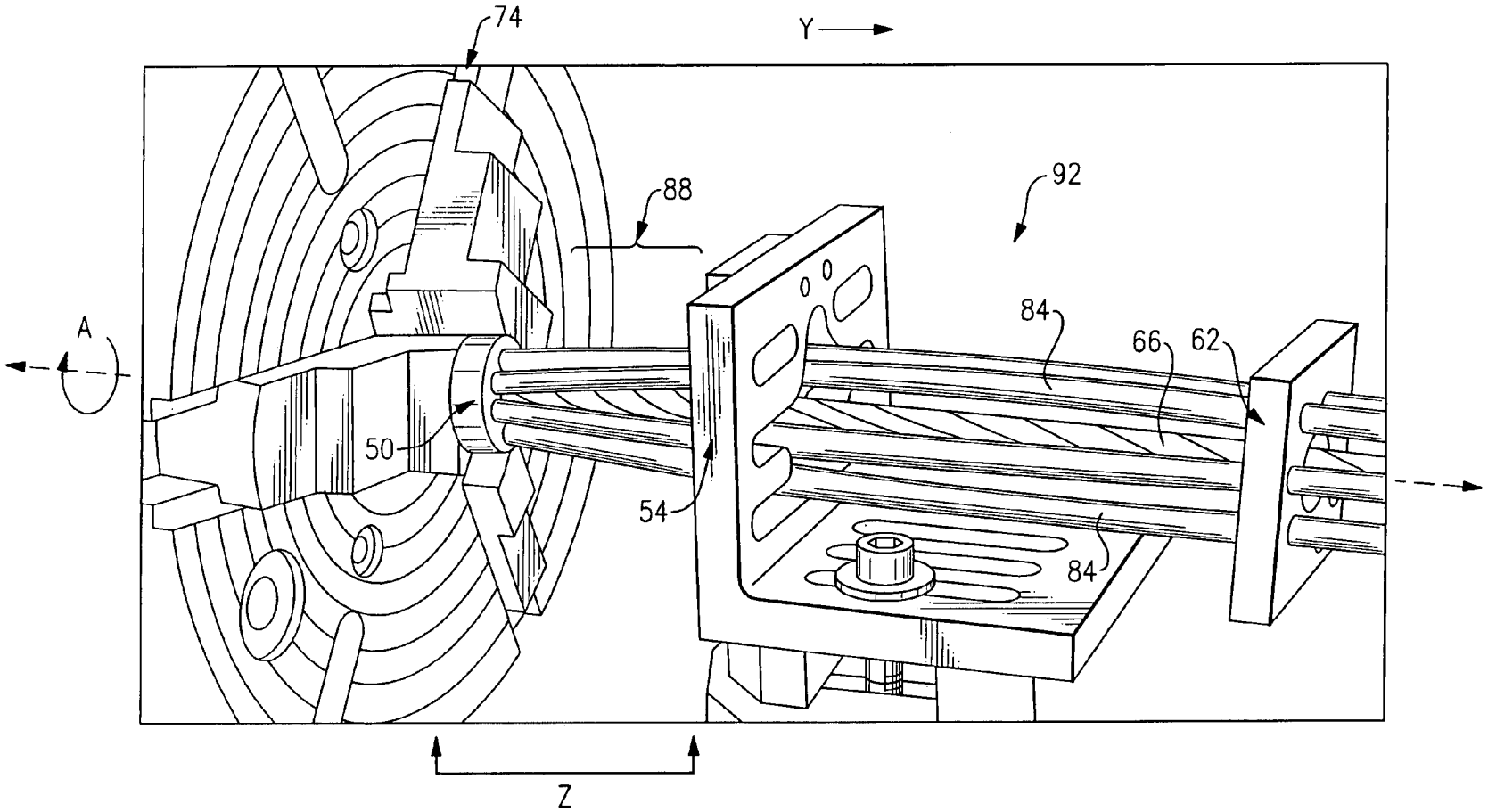
FIG. 4 illustrates equipment used to construct the multiple tube spiral heat exchanger.

FIG. 4 illustrates equipment used to create multiple tube heat exchanger 14. Here, six tubes 84 are mounted to fixture 50 and inserted into lathe 74 to be intertwined. As shown in FIGS. 5A and 5B, fixture 50 will have enough holes 78 to accommodate each tube 84. Each hole 78 is of sufficient diameter to receive each tube 84. In addition, fixture 50 will have a predetermined hole pattern that will dictate the gaps between the tubes.

As shown in FIG. 5A, fixture 50 has six holes 78 spaced approximately equal distance apart to create gap 82. In addition, as shown in FIG. 4 and 5A, axial guide 66 is spaced within gap 82 so that tubes 84 may wind around axial guide 66 as lathe 74 is rotated in the direction of arrow A along axis X. Axial guide 66 may have a predetermined spiral pattern as shown in FIG. 4 so that tubes 84 may be wound around axial guide 66 to conform to this spiral pattern, say, the pattern required by any particular application.

Figure 6:
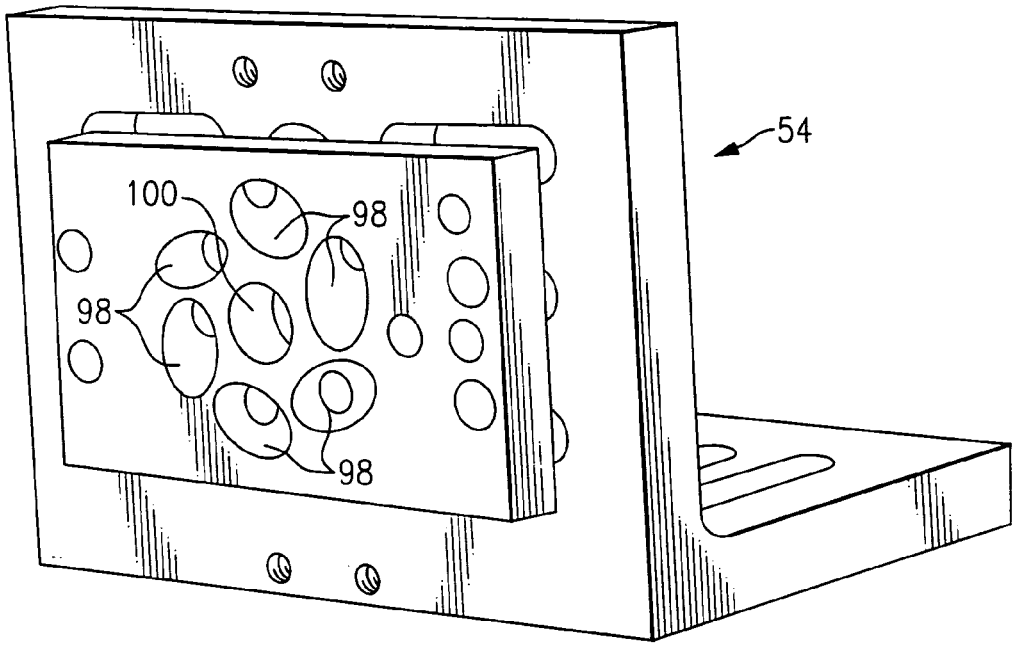
FIG. 6 illustrates a first guide used in the winding of the multiple tubes.

As shown in FIG. 4, tubes 84 are passed through first guide 54. As shown in FIG. 6, first guide 54 has six holes 98 to accommodate each tube 84 and one hole 100 to receive axial guide 66. Holes 98 of first guide 54 are preferably oval in shape, smooth around the edges and larger than holes 78 of fixture 50 to facilitate the passing of tubes 84 through guide 54.

Figure 7:
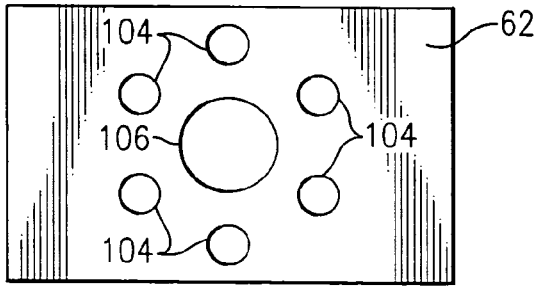
FIG. 7 illustrates a second guide used in the winding of the multiple tubes.

As shown in FIG. 4, spaced from first guide 54 is second guide 62. As shown in FIG. 7, second guide 62 has holes 104 of sufficient number and size to receive tubes 84 and has a hole 106 to receive axial guide 66. Second guide 62 prevents tubes 84 from rotating with lathe 74 along the direction of arrow A like first guide 54. Tubes 84 otherwise have a tendency to flail in this direction. In addition, second guide 62 is moveable along the X axis like first guide 54.

In this way lathe 74 turns fixture 50 and tubes 84 in the direction of arrow A to wind tubes 84 around axial guide 66. The tubes are twisted in the space between fixture 50 and first guide 54, first tube segment 88. However, first guide 54 and second guide 62 prevent tubes 84 from winding around axial guide 66. Accordingly, second tube segment 92 remains unwound around axial guide 66. As a consequence, the winding of tubes in first tube segment 88 will be more uniform. As tubes 84 are intertwined, first guide 54 and second guide 62 are then moved along the X axis in the direction of arrow Y. It is preferable that first guide 54 be maintained at a predetermined distance from the location of formed loops between end fixture 50 and first guide 54 as shown by distance Z in FIG. 4.

Figure 8:
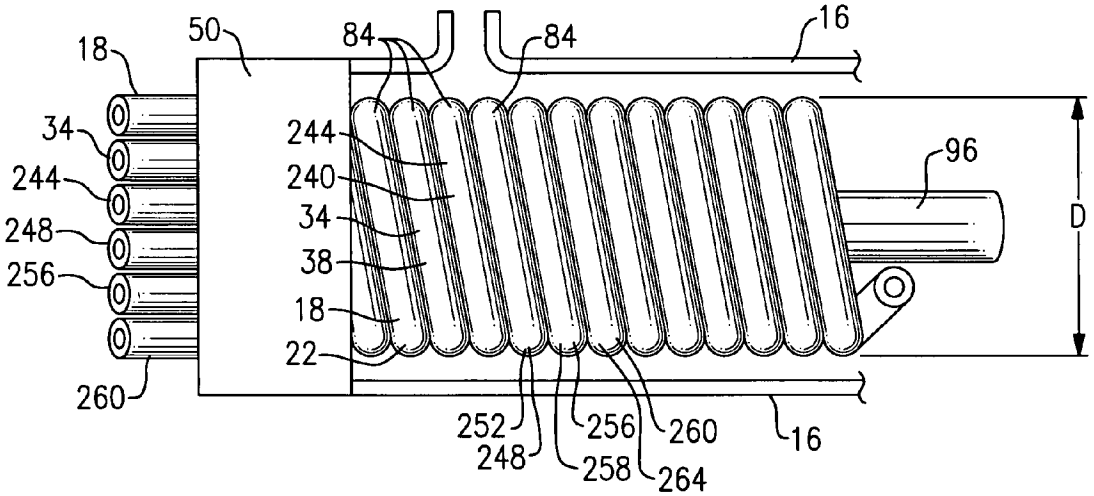
FIG. 8 illustrates another heat exchanger with multiple tubes wound by the inventive method.

Once tubes 84 have been completely wound, axial guide 66 is then removed from the wound tubes 84. As shown in FIG. 8, axial guide 66 may then be replaced with another tube heat exchanger, tube 96, which may be inserted into the space previously occupied by the axial guide. Tube 96 may be another twisted multiple tube heat exchanger or a simple cylinder that conducts another fluid. Tubes 84 and tube 96 may then be inserted into cylinder 16, which may then be capped by another fixture 50.

The heat exchangers and their functioning will now be explained in detail. Referring to FIG. 1, heat exchanger 14 has first heat exchanger tube 18 and second heat exchanger tube 34 intertwined in a spiral around axis X so that first loop 22 of first heat exchanger tube 18 contacts second loop 38 of second heat exchanger tube 34. As a consequence of the spiraling of these tubes together, first loop 22 contacts second loop 38 very closely to promote heat exchange. As further shown in FIG. 1, first loop 22 has angle β while second loop has angle α relative to axis X. Angle α is generally the same as angle β to further ensure a close fit between first heat exchanger tube 18 and second heat exchanger tube 34. In addition, formed within first loop 22 and second loop 38 is volume 222. Volume 222 may receive another heat exchange element to further improve heat exchange.

Heat exchange is accomplished in the following manner. First fluid 208, such as water, enters through first fluid inlet 200 and passes through fluid volume 17 out through first fluid outlet 204 as shown. In addition, second fluid 212 and third fluid 218 are passed through first heat exchanger tube 18 and second heat exchanger tube 34, respectively. Second fluid 212 and third fluid 218 may, in fact, be the same or different fluids. As shown, second fluid 212 passes from one end of heat exchanger tube 18 out the other end. The same is true for third heat exchanger fluid 218 and second heat exchanger tube 34. As fluids 208, 212 and 218 pass each other, they exchange heat. Because first heat exchanger tube 18 and second heat exchanger tube 34 are two different tubes, the two fluids 212, 218 may be kept separate from one another yet brought close enough together for heat exchange. Moreover, as further shown in FIG. 1, the direction of second fluid 212 and third fluid 218 are opposite to the direction of first fluid 208. This technique enhances fluid turbulence so that when fluids 208, 212, and 218 pass each other, they exchange heat more efficiently.

Furthermore, end caps 50 serve to separate fluids 212 and 218 from fluid 208. Specifically, fluids 212 and 218 may pass through end caps 50 while fluid 208 does not as end caps 50 serve to contain fluid 208 with volume 17 as fluid 208 passes from inlet 200 to outlet 204. In this way, the fluids 208, 212 and 218 may be separated.

Figure 9:
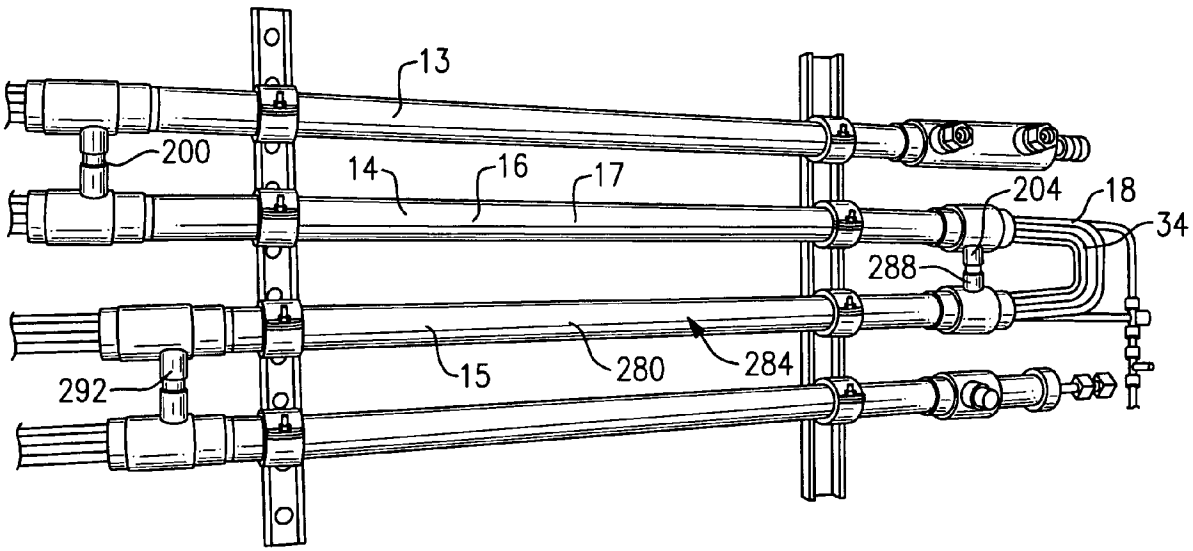
FIG. 9 illustrates a number of linked heat exchangers.

As shown in FIG. 9, heat exchanger 14 may be interconnected to similarly constructed heat exchangers. Heat exchanger 14 is interconnected to like constructed heat exchanger 13 and heat exchanger 15. Fluid, such as water, is passed through first fluid inlet 200 from heat exchanger 13 to heat exchanger 14. Water then passes through the length of heat exchanger 14 out first fluid outlet 204 (as shown in FIG. 1) to heat exchanger 15 through second fluid inlet 288, which is in communication with first fluid outlet 204 of heat exchanger 14. Water is then passed through second housing 280 of heat exchanger 15 through second fluid volume 284 within the interior of second housing 280 and finally passes out second fluid outlet 292. In this way, fluid may pass through multiple heat exchangers either in parallel or series circuits to exchange heat with coils housed within each of the heat exchangers without intermingling of the fluids.

Figure 10:
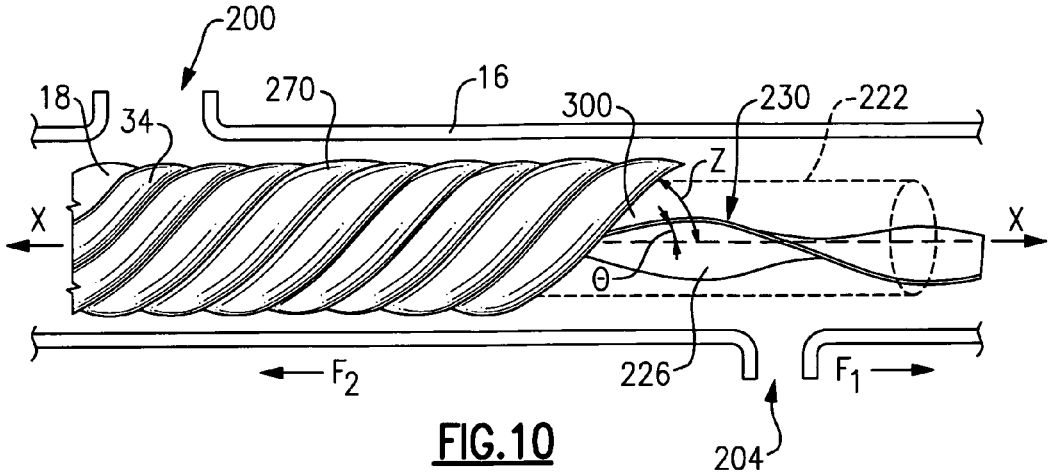
FIG. 10 illustrates a heat exchanger with a thermally conductive element.

As shown in FIG. 10, to enhance heat exchange, thermally conductive element 226 is spaced within volume 222, formed as explained above. Thermally conductive element 226 comprises a piece of metal, such as copper, having first spiral 230 along direction $F_1$ and forming angle θ with axis X. First heat exchanger tube 18 and second heat exchanger tube 34 form spiral 300 in the direction of arrow F2, a direction opposite to the direction of arrow $F_1$ and second spiral 300 forms angle Z with axis X. As shown, angle θ is less than angle Z. By placing thermally conductive element 226 within volume 222 and spiraling this element in this fashion, turbulence of fluid within housing 16 is promoted to improve the heat exchange of fluid housing 16 and fluids within first heat exchanger 18 and second heat exchanger tube 34.

Figure 11:
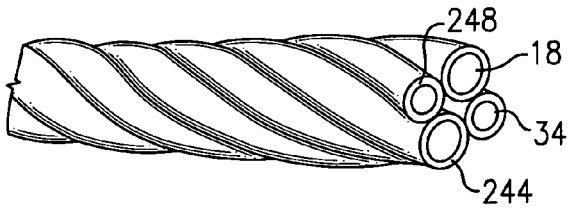
FIG. 11 illustrates a heat exchanger with four tubes.
Figure 12:
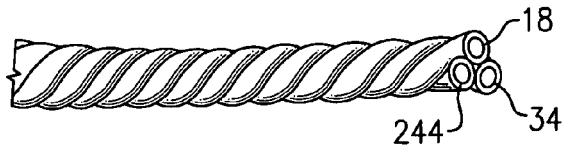
FIG. 12 illustrates a heat exchanger with three tubes.

As shown in FIGS. 8, 11 and 12, multiple tubes, say three as show in FIG. 12, four as shown in FIG. 11, and six tubes as shown in FIG. 8, may be intertwined to allow for the heat exchange of multiple fluids without intermingling of the fluids in each tube. Each of the heat exchangers shown in FIG. 8, 11 and 12 may be manufactured by the process described before. As shown in FIG. 8, these multiple tubes may be intertwined so that first loop 22 of first heat exchanger tube 18 neighbors second loop 38 of second heat exchanger tube 34, which neighbors third loop 244 of third tube 240, which neighbors fourth loop 252 of fourth tube 248, which neighbors fifth loop 258 of fifth tube 256, which finally neighbors sixth loop 264 of sixth tube 260. As shown, first loop 22, second loop 38, third loop 244, fourth loop 252, fifth loop 258 and sixth loop 260 have common diameter D. As known, the tightness of the spiral, the tube length, the number of tubes, the diameter of the tubes as well as the angle of the spiral of these tubes may be adjusted to accomplish the particular needs of a given heat exchange task.

Accordingly, the aforementioned description is exemplary rather that limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. A heat exchanger comprising:

a first thermally conductive tube for conducting a fluid;

a second thermally conductive tube for conducting a fluid;

a third thermally conductive tube for conducting a fluid;

wherein said first thermally conductive tube forms a first loop, said second thermally conductive tube forms a second loop, and said third thermally conductive tube forms a third loop, said first loop neighboring said second loop and said second loop neighboring said third loop, said first loop, said second loop, and said third loop coiled concentrically around a common axis and having a common diameter.

2. The heat exchanger of claim 1 wherein said first loop contacts said second loop.

3. The heat exchanger of claim 2 wherein said first loop and said second loop coil around said common axis along a generally common angle relative to said common axis.

4. The heat exchanger of claim 1 including a housing for housing said first loop and said second loop.

5. The heat exchanger of claim 4 wherein said housing comprises a third tube, said housing having a fluid inlet and a fluid outlet.

6. The heat exchanger of claim 1 wherein a volume is formed within said first loop and said second loop.

7. A heat exchanger comprising:

a first thermally conductive tube for conducting a fluid;

a second thermally conductive tube for conducting a fluid;

wherein said first thermally conductive tube forms a first loop and said second thermally conductive tube forms a second loop, said first loop neighboring said second loop;

wherein a volume is formed within said first loop and said second loop; and wherein a thermally conductive element is spaced within said volume.

8. The heat exchanger of claim 7 wherein said thermally conductive element has a first spiral and said first loop and said second loop form a second spiral, said first spiral spiraling in a first direction and said second spiral spiraling in a second direction opposite said first direction.

9. The heat exchanger of claim 7 wherein said thermally conductive element comprises a fluid conducting tube.

10. The heat exchanger of claim 8 wherein said first loop contacts said second loop.

11. The heat exchanger of claim 10 wherein said thermally conductive element and said first loop and said second loop share a common axis, said first spiral crossing said common axis at a different angle than said second spiral.

12. A heat exchanger comprising:

a first thermally conductive tube for conducting a fluid, said first thermally conductive tube forming a first loop;

a second thermally conductive tube for conducting a fluid, said second thermally conductive tube forming a second loop;

wherein said first loop neighbors said second loop, said first loop and said second loop coiling around a common axis;

a housing for housing said first loop and said second loop, said housing forming a fluid volume around said first loop and said second loop;

wherein said housing has a first fluid inlet and a first fluid outlet; and wherein a second housing has a second fluid volume, said second housing having a second fluid inlet and a second fluid outlet wherein said first fluid outlet is in fluid communication with said second fluid inlet.

13. The heat exchanger of claim 12 wherein said first thermally conductive tube and said second thermally conductive tube are in fluid communication with said second housing.

* * * * *